United States Patent [19]

Eberle

[11] Patent Number: 4,692,575

[45] Date of Patent: Sep. 8, 1987

[54] VACUUM SENSITIVE SWITCH

[76] Inventor: William J. Eberle, 2812 Riverlake Ct., Irving, Tex. 75060

[21] Appl. No.: 827,389

[22] Filed: Feb. 10, 1986

[51] Int. Cl.[4] ..... H01H 35/34

[52] U.S. Cl. ..... 200/82 C; 200/81 R; 73/745

[58] Field of Search ..... 200/82 R, 82 C, 81 R, 200/83 S, 83 W, 83 Q, 84 B, 153 T; 340/611, 626; 73/745

[56] References Cited

U.S. PATENT DOCUMENTS

| | | | |
|---|---|---|---|
| 2,071,042 | 2/1937 | Maurer | 200/83 W |
| 3,639,898 | 2/1972 | Booth | 200/83 Q |
| 3,933,388 | 1/1976 | Conboy | 254/270 |
| 4,219,710 | 8/1980 | Booth | 200/81 R |
| 4,266,905 | 5/1981 | Birk | 294/64.1 |

*Primary Examiner*—G. P. Tolin

*Attorney, Agent, or Firm*—Kanz, Scherback & Timmons

[57] ABSTRACT

A switch responsive to fluctuations in the level of a vacuum. A ball is contained in an upright chamber and is normally in contact with an actuating means in the chamber. The actuating means is normally biased to one position but is shifted by the weight of the ball to another position. The chamber is connected to the vacuum source so as to apply a lifting suction force to the ball. If the suction force exerted by the vacuum exceeds a predetermined level, the ball will be lifted from the actuating means thereby shifting the position of the actuating means and generating a signal indicative of the vacuum level. Means are provided to adjust the level of vacuum necessary to lift the ball from the actuating means.

4 Claims, 3 Drawing Figures

VACUUM SENSITIVE SWITCH

FIELD OF THE INVENTION

This invention relates generally to switches, and more particularly to switches responsive to fluctuations in the level of a vacuum.

BACKGROUND OF THE INVENTION

Switches have been developed in the past that are responsive to fluctuations in the level of a vacuum. Such switches may be used to generate a signal indicative of the status of a machine or to actuate a machine based on the detected vacuum level. For instance, such switches are used in U.S. Pat. No. 4,266,905 entitled "Apparatus For Acquiring Workpieces From A Storage Bin Or The Like". The apparatus disclosed therein utilizes suction to lift and carry randomly positioned articles from a container. The apparatus creates a vacuum at the end of an arm adapted to contact the article. However, when the arm is not in contact with one of the articles, the vacuum in the arm is reduced through exposure to the atmosphere. When an article is contacted, the end of the arm is closed off to the atmosphere and the level of the vacuum is increased. The increase in the vacuum is detected by a vacuum sensitive switch which generates a signal indicative of the fact that the arm has contacted and is carrying an article. U.S. Pat. No. 3,933,388 entitled "Interlock Control System For A Fluid-Operated Hoist" is another example of vacuum sensitive switches utilized to generate a signal responsive to fluctuations in the level of a vacuum.

However, conventional vacuum responsive switches exhibit certain inherent limitations and ineffeciencies. Specifically, conventional vacuum sensitive switches are not sensitive to relatively low levels of pressure or to relatively small pressure fluctuations, which are commonly encountered. Conventional switches typically have a pressure sensitivity of at least 4–5" water, whereas a greater sensitivity is desirable in many situations. Further, it is frequently desirable to adjust the level of vacuum which will actuate the switch, which is difficult to accomplish with conventional vacuum sensitive switches.

SUMMARY OF THE INVENTION

The switch of the present invention includes a body defining a chamber containing a ball. Actuating means, which may take the form of an electrical microswitch, is mounted on the body within the lower portion of the chamber. The electrical microswitch is biased to a first position, which may be either open or closed. The ball is normally urged downward under the influence of gravity, resting on the electrical microswitch and shifts the electrical microswitch to a second position. A conduit connects the upper portion of the chamber to the source of vacuum to be sensed by the switch. The vacuum creates a suction force in the upper portions of the chamber which is exerted on the ball and urges the ball upwardly, away from the electrical microswitch. If the vacuum exceeds a predetermined level, the ball will be lifted upwardly and the electrical microswitch will automatically shift positions, thereby generating a signal indicative of the increase in the level of the vacuum.

In the preferred embodiment of the invention, means are also provided to vary the predetermined level of vacuum required to lift the ball from the electrical microswitch. In one embodiment, the adjustment means takes the form of an orifice communicating between the chamber and the atmosphere exteriorly of the switch body. The passage of the air to the chamber through the orifice will reduce the vacuum within the chamber and the suction force exerted on the ball tending to lift the ball away from the electrical microswitch. A screw is threadedly mounted in the switch body and extends into the orifice. By extending or retracting the screw from the orifice, the reduction of the vacuum in the chamber may be adjusted, and consequently, the predetermined level of vacuum required to lift the ball from the electrical microswitch is also adjusted.

Therefore, it is a principal feature and advantage of this invention to provide an improved vacuum sensitive switch.

It is another feature and advantage of this invention to provide an improved vacuum sensitive switch responsive to fluctuations in low levels of vacuum.

It is yet another feature and advantage of this invention to provide an improved vacuum sensitive switch with increased sensitivity.

It is another feature and advantage of this invention to provide an improved vacuum sensitive switch in which the predetermined level of vacuum necessary to actuate the switch is adjustable.

BRIEF DESCRIPTION OF THE DRAWING

So that the manner in which the above recited features and advantages of the invention, as well as others which will become apparent to those skilled in the art, are obtained and can be understood in detail, a more particular description of the invention briefly summarized above may be had by reference to the embodiments thereof which are illustrated in the accompanying drawings, which drawings form a part of the specification and in which like numerals depict like parts in the several views. It is noted, however, that the appended drawings illustrate only a preferred embodiment of the invention and are therefore not to be considered limiting of its scope, for the invention may admit to other equally effective embodiments.

DETAILED DESCRIPTION OF THE INVENTION

Figure 1:
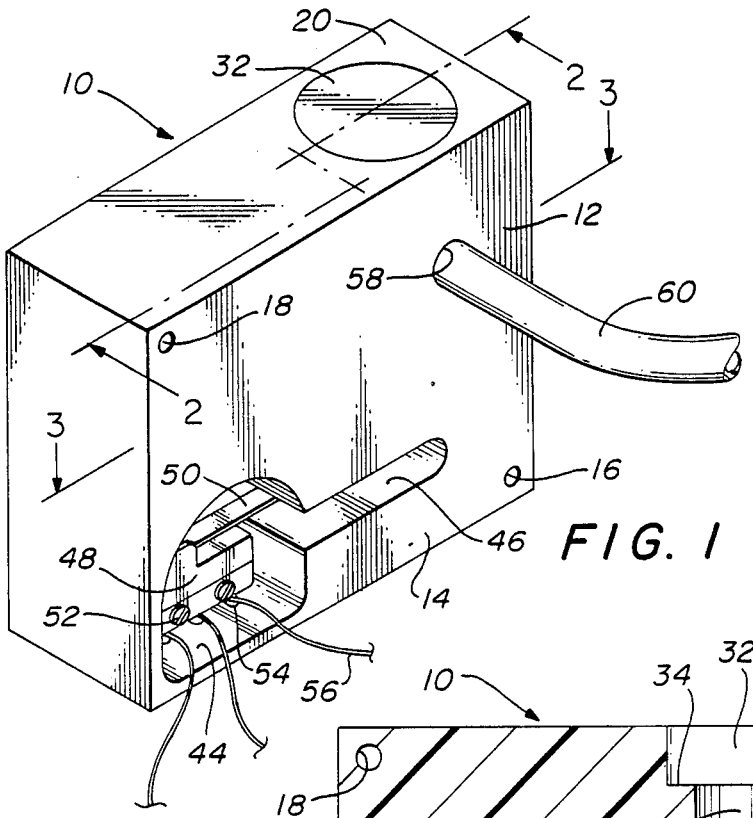
FIG. 1 is a perspective view of a switch according to this invention.
Figure 2:
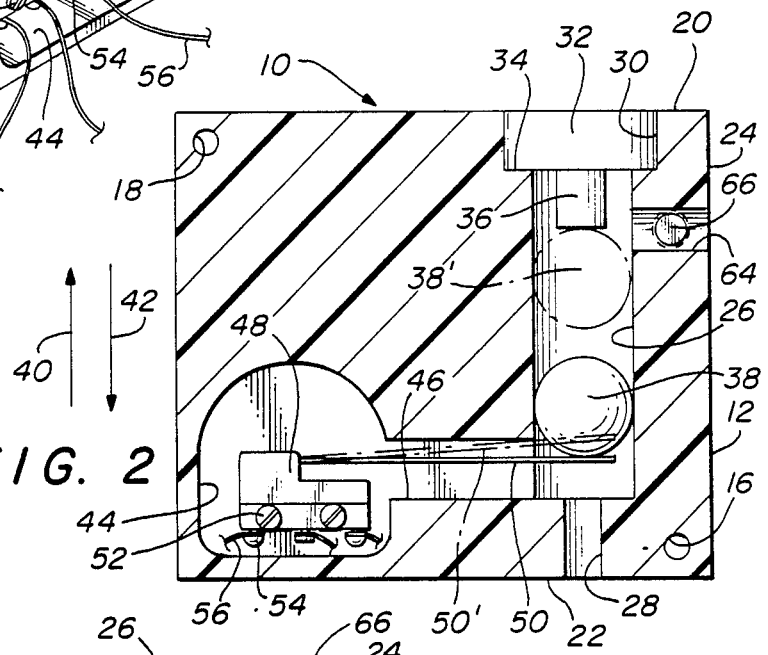
FIG. 2 is a cross sectional view of the switch of FIG. 1 along plane 2—2.
Figure 3:
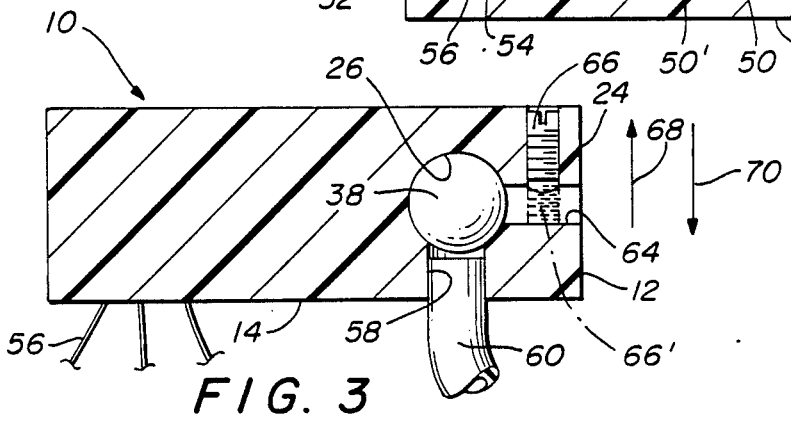
FIG. 3 is a cross sectional view of the switch of FIG. 1 along plane 3—3.

Referring now to FIGS. 1–3, the reference numeral 10 generally indicates a vacuum sensitive switch according to this invention. The switch includes body 12 having front side 14 and mounting holes 16 and 18 at opposite corners thereof extending through the body for securing the switch to a mounting surface (not shown) such as by screws or bolts (not shown). The body also includes top side 20, bottom side 22, and right end 24. Chamber 26 is formed in the body and extends from the top side to the bottom side of the body. Chamber 26 includes a middle portion and bottom end portion 28 of reduced diameter and top end portion 30 of enlarged diameter. Cap 32 is located within the top end portion of the chamber flush with top side 20 and seals against shoulder 34 of the chamber at the juncture of the middle portion and the top end portion. The cap includes stop 36 depending downwardly from the cap into the chamber. Ball 38 is constrained in the chamber with a diameter slightly less than that of the chamber. The ball may travel under the influence of gravity in direction 42 (in FIG. 2) within the chamber to a lower position adajacent the juncture of the bottom end portion and the middle portion, or travel in opposite direction 40 to an upper position (shown at 38') in contact with stop 36 of cap 32. Although the chamber may be inclined, in the preferred embodiment of the invention the chamber is maintained in an upright position, enabling the ball to be shifted between its lower and upper positions with a minimum of frictional contact with the walls of the chamber.

Actuating means are provided to generate a signal indicative of the vacuum sensed within the chamber. In the illustrated embodiment, the actuating means takes the form of electrical microswitch 48 mounted in recess 44, such as by screws 52. Terminals 54 extend from the electrical microswitch and may be connected to conductive wires 56 for connecting the electrical microswitch to an external electrical circuit (not shown). Recess 44 is formed in the body adjacent the bottom side and includes slot 46 extending to and in communication with the chamber. The electrical microswitch also includes actuating arm 50 which is pivotally mounted on the electrical microswitch at one end, with the other end extending through recess 46 and terminating in the lower end of the chamber beneath the ball. The actuating arm is biased to a first position, as at 50'. The actuating arm may also assume a second position as shown in FIG. 2, under the weight of the ball in its lower position. Depending on the particular application for the electrical microswitch of this invention and the electrical circuit to which it is attached, the first position of the actuating arm may represent an open condition for the electrical microswitch, and the second position a closed condition for the electrical microswitch, or vice versa, without otherwise affecting the operation of the switch of this invention.

Opening 58 is formed in body 12 in the upper end of the chamber. Conduit 60 is mounted at one end in the opening and extends to a remote vacuum source (not shown) that the switch is to monitor. The upper portion of the chamber will thus also contain a vacuum communicated through conduit 60 from the vacuum source. The vacuum in the chamber will exert a suction force on the ball, urging the ball away from its lower position to an upper position (shown at 38') in contact with stop 36 of the cap. The level of vacuum necessary to lift the ball from its lower position to its upper position may be precisely predetermined and is dependent upon, among other things, the weight of the ball, the relative diameters of the ball and the chamber and the location within the chamber of the opening connected to the source of vacuum. The vacuum sensitive switch of the present invention is enabled to achieve a high level of sensitivity (i.e. 0.5" water) and to detect fluctuations in relatively low vacuum levels, as compared to conventional switch designs. In the illustrated embodiment, this sensitivity and response to low levels of vacuum is achieved due to the relatively long length of the actuating arm of the electrical microswitch, compared to conventional designs. The leverage provided by the actuating arm enables a lighter ball to shift the electrical microswitch to its second position. The lighter ball will be responsive to a lower level of vacuum and exhibits increased sensitivity to fluctuations in the vacuum level. Further, the present invention includes few moving parts and is thus more reliable than existing designs. Once the predetermined level of vacuum is achieved, the ball is lifted and the electrical microswitch automatically shifts it position and generates an electrical signal indicative of the increased vacuum level. If the vacuum level drops below the predetermined value, the ball will drop to its lower position on the actuating arm, and the electrical microswitch will generate a different signal responsive to the change in the vacuum level.

It is often desirable to adjust the predetermined vacuum level at which the switch will be activated. For this purpose in the illustrated embodiment of the invention, orifice 64 is formed in the switch body extending from the upper end of the chamber above the upper position of the ball to the atmosphere exteriorly of the switch. To the extent that atmospheric pressure infiltrates into the chamber through orifice 64, the vacuum and the suction force exerted on the ball will be reduced. Screw 66 is threadedly located in the body perpendicular to orifice 64. By rotating the screw, it may be inserted in direction 70 in FIG. 3 across orifice 64 so as to obstruct the infiltration of atmospheric pressure into the chamber (as at 66'). Or, the screw may be retracted in direction 68 from the orifice, allowing the suction force to be reduced. Manipulation of the screw 66 within orifice 64 will enable the predetermined vacuum level to be quickly and accurately adjusted to a desirable value by regulating the infiltration of atmospheric pressure into the chamber.

Although the invention has been disclosed above, with regard to particular and preferred embodiments, these are advanced for illustrative purposes only, and are not intended to limit the scope of this invention. For instance, although electrical microswitch has been described as an electrical microswitch, this invention will function equally well by incorporating other types of electrical microswitches, switches, relays or actuators, such as hydraulic or pneumatic switches. Further, alternate embodiments of the invention may include a transparent sight glass mounted in the body enabling external visual monitoring of the position of the ball within the chamber, if desired. These variations remain within the invention as claimed below.

What is claimed is:

1. A switch responsive to vacuum pressure from a vacuum source, comprising:

(a) a body defining a chamber;

(b) a ball within said chamber and moveable between an upper position and a lower position therewithin;

(c) an electrical switch mounted on said body and having an actuating portion within said chamber and beneath said ball and in contact with said ball when said ball is in said lower position, said actuating portion being resiliently biased upwardly to a first position and shifted by the weight of said ball to a second position when said ball is in said lower position; and (d) means including an unobstructed conduit extending through said body from an upper end of said chamber to the outside of said body for continuously applying vacuum pressure to an upper portion of said ball, at all times regardless of whether the ball is rising or falling, whereby the vacuum pressure will exert an upward suction force on said ball so as to lift said ball from said actuating means and shift said actuating means from said second to said first position when the level of the vacuum pressure attains a value necessary to lift said ball to said upper position.

2. The switch of claim 1, further including means independent of said conduit mounted on said body communicating with the upper end of said chamber for adjusting the level of vacuum required to lift said ball to said upper position.

3. The switch of claim 2, wherein said adjustment means comprises:

(a) an orifice formed in said switch body extending from the upper end of said chamber to the outside of said body so as to enable atmospheric pressure to infiltrate to said chamber and reduce the suction force on the ball; and (b) a screw threadedly mounted in said body and moveable transversely into and out of said orifice, whereby the suction force exerted on said ball by the vacuum pressure is adjustable by inserting or retracting said screw from said orifice so as to regulate the infiltration of atmospheric pressure into said chamber.

4. The switch of claim 1 including stop means depending from said body into the upper end of said chamber to establish said upper position at a point below at least a portion of said conduit thus permitting at all times the application of vacuum pressure to said upper end of said chamber by way of said conduit.

* * * * *